US007623814B2

(12) United States Patent
Kuo et al.

(10) Patent No.: US 7,623,814 B2
(45) Date of Patent: Nov. 24, 2009

(54) SINGLE-PASS BYPASS PRINTING METHOD AND APPARATUS

(75) Inventors: Youti Kuo, Penfield, NY (US); Joseph H Rowe, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 261 days.

(21) Appl. No.: 11/767,892

(22) Filed: Jun. 25, 2007

(65) Prior Publication Data

US 2008/0317505 A1 Dec. 25, 2008

(51) Int. Cl.
*G03G 15/01* (2006.01)
*G03G 15/00* (2006.01)

(52) U.S. Cl. ..... 399/223; 399/298; 399/388

(58) Field of Classification Search ..... 399/223, 399/298, 384, 388, 401
See application file for complete search history.

(56) References Cited

U.S. PATENT DOCUMENTS 3,935,424 A 1/1976 Donnelly et al.
4,427,285 A 1/1984 Stange
5,260,725 A 11/1993 Hammond
5,274,428 A 12/1993 Wong et al.
5,347,353 A 9/1994 Fletcher
5,613,176 A 3/1997 Grace
5,807,652 A 9/1998 Kovacs
5,837,408 A 11/1998 Parker et al.
5,848,345 A 12/1998 Stemmle
5,946,533 A * 8/1999 Omelchenko et al. ..... 399/223
6,163,672 A 12/2000 Parker et al.
6,684,045 B2 * 1/2004 Viturro et al. ..... 399/223

* cited by examiner

*Primary Examiner*—Sandra L Brase
(74) *Attorney, Agent, or Firm*—Oliff & Berridge, PLC

(57) ABSTRACT

A single-pass bypass printing machine including: (a) a moveable photoreceptor belt for moving through an imaging path; (b) apparatus for supplying and feeding print media along a main media path and a bypass media path; (c) a first stage including at least three imaging subassemblies for forming a first color toner image on the photoreceptor; (d) a first transfer station for transferring the first color toner image onto the print media; (e) apparatus for diverting the print media from the main media path onto the bypass media path; (f) a second stage including at least one marking engine for forming a second color toner image on the photoreceptor; (g) apparatus for moving the print media from the bypass media path back into the main media path; and (h) a second transfer station for transferring the second color toner image onto the print media, forming a desired multi-color toner image on the print media.

21 Claims, 3 Drawing Sheets

SINGLE-PASS BYPASS PRINTING METHOD AND APPARATUS

The present disclosure relates to electrostatographic image producing machines and, more particularly to a single-pass bypass printing method and apparatus for producing multi-color images.

Generally, electrostatographic copying is performed in cycles by exposing an image of an original document onto a substantially uniformly charged photoreceptive member. The photoreceptive member has a photoconductive layer. Ordinarily, exposing the charged photoreceptive member with the image discharges areas of the photoconductive layer corresponding to non-image areas of the original document, while maintaining the charge in the image areas. Thus, a latent electrostatic image of the original document is created on the photoconductive layer of the photoreceptive member.

Charged developing material is subsequently deposited on the photoreceptive member to develop the latent electrostatic image areas. The developing material may be a liquid material or a powder material. The charged developing material is attracted to the charged image areas on the photoconductive layer. This attraction develops the latent electrostatic image into a visible toner image. The visible toner image is then transferred from the photoreceptive member, either directly or after an intermediate transfer step, to a copy sheet or other support substrate as an unfused toner image which is then heated and permanently affixed to the copy sheet, resulting in a reproduction or copy of the original document. In a final step, the photoconductive surface of the photoreceptive member is cleaned to remove any residual developing material in order to prepare it for successive imaging cycles.

In multi-color electrostatographic printing, rather than forming a single latent image on the photoconductive surface, successive latent images, corresponding to different color separations, must be created. Each single color latent electrostatic image is developed with a corresponding colored toner. This process is repeated for a plurality of cycles. By anyone of several processes, each single-color toner image is eventually superimposed over the other and then results in a single multi-color toner image on the copy sheet. Thereafter, the multi-color toner image is also heated and then permanently fixed to a copy sheet, creating a full-color copy.

In a conventional tandem color printing process, four imaging systems are typically used. Photoconductive drum imaging systems are typically employed in tandem color printing due to the compactness of the drums. Although drums are used in the preferred embodiments, a tandem system can alternatively use four photoconductive imaging belts instead of the drums. Each imaging drum or belt system charges the photoconductive surface thereof, forms a latent image on the thereon, develops it as a toned image and then transfers the toned image to an intermediate belt or to a print media. In this way, yellow, magenta, cyan, and black single-color toner images are separately formed and transferred. When superimposed, these four toned images can then be fused, and are capable of resulting in a wide variety of colors.

In single pass image-on-image color printing, an endless photoreceptor belt, a controller and a series of imaging subassemblies are employed that each include a charging unit, a color separation latent image exposure ROS unit or LED print bar, and a corresponding color toner development unit. As the endless photoreceptor belt moves in an indicated direction, an image frame thereon is charged, exposed and developed, in succession, by each imaging subassembly, with each imaging subassembly thus forming a color separation image corresponding to color separation image input video data from the controller. After the first imaging subassembly forms its color separation toner image, that color separation toner image is then recharged and re-exposed to form a different color separation latent image, and then correspondingly developed by the next imaging subassembly. After the final color separation image is thus formed, the multi-color image is then ready to be transferred from the image frame at transfer station to a print media.

Following is a discussion of prior art, incorporated herein by reference, which may bear on the patentability of the present disclosure. In addition to possibly having some relevance to the question of patentability, these references, together with the detailed description to follow, are intended to provide a better understanding and appreciation of the present disclosure.

U.S. Pat. No. 5,347,353 issued Sep. 13, 1994 to Fletcher and entitled "Tandem high productivity color architecture using a photoconductive intermediate belt" discloses a system in which tandem, high productivity color images are formed by using a photoconductive belt as an imaging surface and as a transferring device. A multi-colored image is produced comprising a plurality of color layers. The apparatus includes a charging device, an image forming device, and a developing device located along a photoconductive belt to form a toned image layer on the belt. Additional color layers may be provided by either photoreceptive imaging drums or additional photoconductive belts.

U.S. Pat. No. 6,163,672 issued Dec. 19, 2000 to Parker et al. and entitled "Tandem tri-level xerographic apparatus and method for producing highly registered pictorial color images" discloses apparatus and method for creating highly registered quality pictorial color images include a first tri-level xerographic module using first and second color marking materials for creating and developing a first tri-level image including custom CAD and custom DAD image areas having different voltage levels respectively to form a first composite color separation image; a transfer station for transferring the first composite color separation image onto an intermediate transfer member; a second tri-level xerographic module using third and fourth color marking materials for similarly creating and developing a second tri-level image including custom CAD and custom DAD image areas having different voltage levels respectively to form a second composite color image; a transfer station for transferring the second composite color separation image, in registration onto the intermediate transfer member; a third tri-level xerographic module using fifth and sixth color marking materials for similarly creating and developing a third tri-level image including custom CAD image areas and custom DAD image areas having different voltage levels respectively to form a third composite color image; wherein pairings of the first and second, third and fourth, and fifth and sixth, color marking materials are selected so that one such pairing is cyan (C) and magenta (M) so as to improve registration of the desired final pictorial image.

U.S. Pat. No. 5,837,408 issued Nov. 17, 1998 to Parker et al. and entitled "Xerocolography tandem architectures for high speed color printing" discloses a full process color imaging system that uses two xerocolography engines in tandem. Each of the two xerocolography engines is capable of creating three perfectly registered latent images with subsequent development thereof in a spot next to spot manner. Each engine is provided with three developer housing structures containing five different color toners including the three subtractive primary colors of yellow, cyan and magenta. Two of the primary colors plus black are used with one of the engines. The third primary color is used with the second tandem engine which also uses one of the primary colors used with the first engine as well as a fifth color which may be a logo or a gamut extending color. The full process color imaging capability provided is effected without any constraints regarding the capability of the laser imaging device to image through previously developed components of a composite image. Also, the development and cleaning field impracticalities imposed by quad and higher level imaging of the prior art are avoided. Moreover, the number of required image registrations compared to conventional tandem color imaging is minimal. Therefore, only one registration is required compared to three or four by conventional tandem engine imaging systems.

U.S. Pat. No. 5,807,652 issued Sep. 15, 1998 to Kovacs and entitled "Process for producing process color in a single pass with three wavelength imager and three layer photoreceptor" discloses a process for producing eight distinct colors, (viz. K, C, M, Y, CM, CY, MY and W) in a single pass with a single exposure in a 3.lambda./3L imaging system is provided. The use of xerocolography with a fifth developer housing containing the same color toner as one of the four normally used developer housings and suitable flood exposure devices overcomes the limitations of prior art K+6 imaging systems which utilize an exposure device capable of emitting light beams at three different wavelengths and a photoreceptor having three layers responsive to the three wavelengths.

U.S. Pat. No. 5,274,428 issued Dec. 28, 1993 to Wong et al. and entitled "Single pass direct transfer color printer" discloses a high throughput, single pass direct transfer color printer utilizing a roll web based design which simplifies tandem engine architecture by eliminating a very difficult subsystem. Improved image registration is achieved simply by position/velocity synchronization of the paper web with respect to photoreceptors of the tandem print engines. Frictional slip between the web and an overrunning vacuum transport develops web tension which in turn provides a positive contact between the web and the photoreceptors needed for good image transfer. An arcuate convex paper path increases normal forces applied to the engines which increases contact pressure, as well as increasing contact surface area of the engines and the web. A web buckle between the vacuum transport and a fuser is provided to reduce vibrational disturbances and a cutter furnishes a printout in an appropriate size.

U.S. Pat. No. 5,613,176 issued Mar. 18, 1997 to Grace and entitled "Image on image process color with two black development steps" discloses a printing system using a recharge, expose and development image on image process color system in which there is an optional extra black development step. The printing system may be a single pass system where all of the colors are developed in a single pass or a multi-pass system where each color is developed in a separate pass. The additional black development step results in optimal color quality with black toner being developed in a first and/or last sequence. Having more than one black development station allows low gloss and high gloss black toner to be applied to the same image, enabling the very desirable combination of low gloss text and high gloss pictorials on the same page.

U.S. Pat. No. 5,260,725 issued Nov. 9, 1993 to Hammond and entitled "Method and apparatus for registration of sequential images in a single pass, color xerographic printer" discloses a single pass, hybrid ROS/print bar system provides a plurality of latent images which may subsequently be developed in different colors. A ROS unit is initially aligned so that each scan line is registered in the process direction. The alignment is accomplished by forming a pair of opposed V-shaped apertures in the surface of the belt and detecting scan line cross-over of the legs of the V. These cross-overs are manifested as two sets of pulses generated by sensors associated with each target leg. The time differences between pulse sets are compared and the scan line is rotated until the time differences are equal. Once the ROS is registered for skew, one or more print bars are registered by enabling non-image pixels and comparing the output generated by detectors when the lit pixels are viewed through the V-shaped aperture.

U.S. Pat. No. 5,848,345 issued Dec. 8, 1998 to Stemmle and entitled "Two sided imaging of a continuous web substrate with moving fusers" discloses a continuous web substrate duplex (both sides) printing system which can utilize a single otherwise conventional or existing xerographic print engine (normally printing conventional cut sheet print substrates) without substantial structural modification, instead of requiring plural print engines on opposite sides of the web. This may be accomplished as shown by operatively docking a special duplex continuous web printing substrate supply module with the cut sheet print engine to form an integral duplex web printing system. Here, this duplex web printing module has an integrated fusing system with translating and half-surface-speed roll fusers for fusing the transferred images on both sides of the web with those two separate moving fusers, with each fuser fusing images on one side of the web after respective separate transfers of sequences of plural first and second web side images. One of these moving fusers is fusing the first side images in an expanding and contracting web loop section of the endless web in between first and second side image transfer stations.

U.S. Pat. No. 3,935,424 issued Jan. 27, 1976 to Donnelly et al. and entitled "Flash fusing apparatus" discloses a flash fusing apparatus for fusing toner images onto flexible support material in which the support material is transported in a cylindrical path encircling the flash fusing lamp which is positioned along longitudinal axis of the path. The cylindrical path is defined a cylindrical member encircling the flash fusing lamp. One or more disc members positioned along the cylindrical path are used to advance the support material along its path with the toner images facing inwardly toward the lamp to receive uniform radiation upon pulsing of the lamp which is activated by a sensing device.

U.S. Pat. No. 4,427,285 issued Jan. 24, 1984 to Stange and entitled "Direct duplex printing on pre-cut copy sheets" discloses a two photoreceptor, single pass duplex reproduction system that has a heat insulating prefuser transport device and first and second transfer stations. In particular, the prefuser transport is a pair of cold, toner compacting rolls adjacent the second transfer station for immediate pick up of a copy sheet supporting unfused images on both sides. The compacting rolls tack the unfused images to the copy sheet. The compacting rolls also insulate the photoreceptor from the heat of the fuser and convey the copy sheet immediately to the fuser. The fuser permanently fixes the images onto the copy sheet in one fuser operation. In a preferred embodiment, the fuser rolls operate at a slightly lower peripheral velocity than the compacting rolls. Also, because of the tacking of the image by the cold rolls, the fuser rolls operate at a relatively lower temperature or pressure than normally.

Conventional single pass color printing systems as disclosed in the examples above ordinarily suffer from needs to address issues concerning (a) tight color registration, (b) image disturbance of unfused images, and (c) ineffective fusing of high pile height multi-color toner images. Yet in recent years the demand for color printing has been increasing at an even more rapid pace. Customers want more choices of colors and flexibility of using a color printer, such as full color capability without using pre-prints, custom colors, and multiple job-appropriate colors. An example of such a system is the Oce VarioStream 9000 which was shown at Graph Expo 2006, and demonstrated printing colored images in black and two custom colors (three-over-three) in a duplex mode. Another is the full-color Oce CPS900 digital color press, and OCE CPT60 dm system that teams multiple print engines in a single configuration.

There is therefore still a need for more machines and methods that can effectively produce more than full color images including five or more colors without suffering from the needs to address issues concerning (a) tight color registration, (b) image disturbance of unfused images, and (c) ineffective fusing of high pile height multi-color toner images.

In accordance with the present disclosure, there has been provided a single-pass bypass printing machine including: (a) a moveable photoreceptor belt for moving through an imaging path; (b) apparatus for supplying and feeding print media along a main media path and a bypass media path; (c) a first stage including at least three imaging subassemblies for forming a first color toner image on the photoreceptor; (d) a first transfer station for transferring the first color toner image onto the print media; (e) apparatus for diverting the print media from the main media path onto the bypass media path; (f) a second stage including at least one marking engine for forming a second color toner image on the photoreceptor; (g) apparatus for moving the print media from the bypass media path back into the main media path; and (h) a second transfer station for transferring the second color toner image onto the print media, forming a desired multi-color toner image on the print media.

The method of the present disclosure includes (a) moving a photoreceptor through an imaging path including a portion having a first direction; (b) first forming a first color toner image on the photoreceptor; (c) moving a print media along a main media path having the first direction; (d) first transferring the first color toner image at a first transfer station onto the print media; (e) diverting the print media from moving along the main media path having the first direction into moving along a bypass media path having a second and different direction; (f) next forming a second color toner image on the photoreceptor; (g) moving the print media along the bypass media path back into the main media path; and (h) next transferring the second color toner image at a second transfer station onto the print media, forming a desired multi-color toner image.

Reference may be had to the accompanying drawing, which includes:

The present disclosure is directed to a novel single pass, bypass, multi-stage, full color web printing machine 100 that reduces the needs to address issues concerning (a) tight color registration, (b) image disturbance of unfused images, and (c) ineffective fusing of high pile height multi-color toner images. The single pass, bypass printing machine 100 as such can include standard multi-color imaging subassemblies 110, 120, 130, custom color imaging subassembly 140 and as many as two black imaging subassemblies 150, 160.

Figure 1:
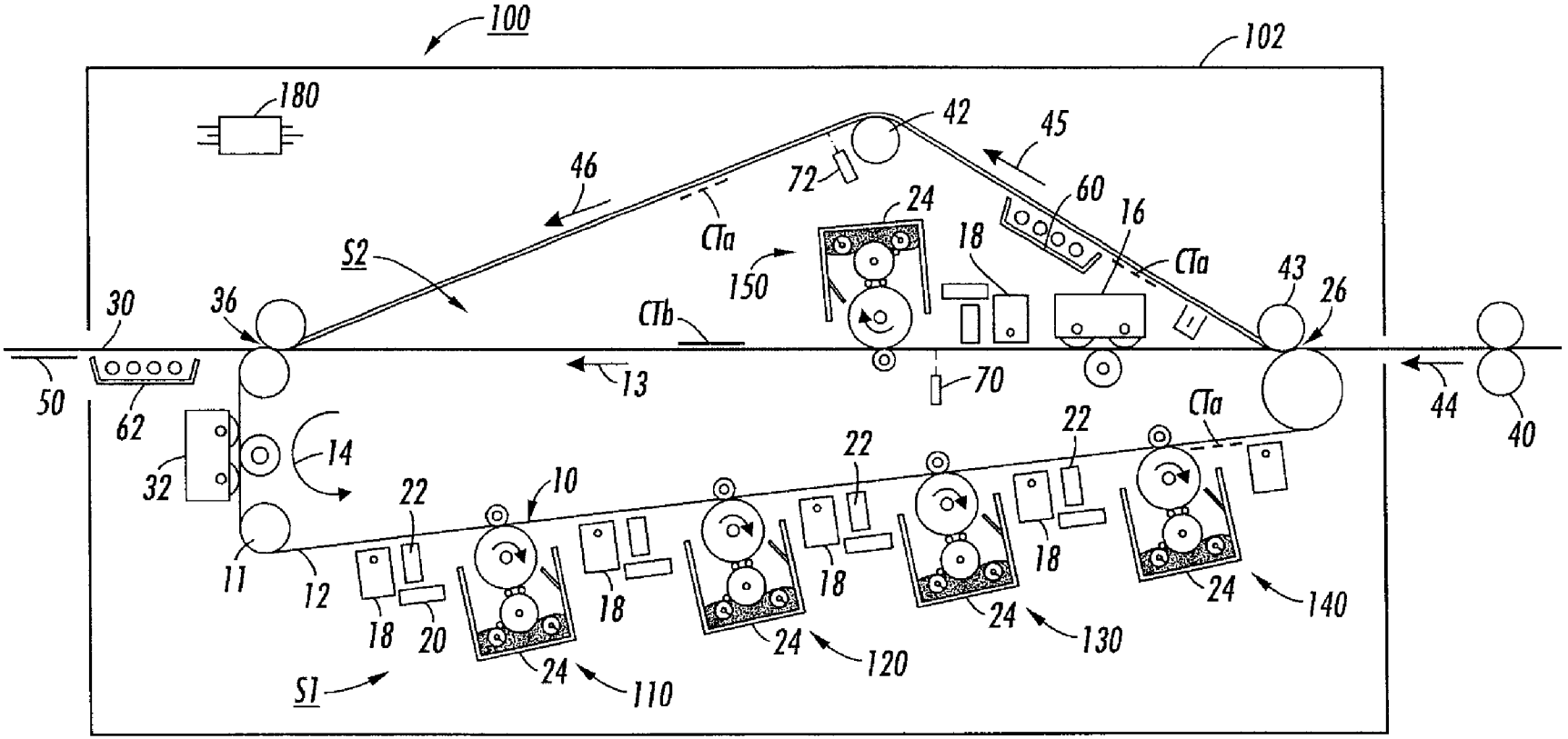
FIG. 1 is a schematic elevational view of a first embodiment of single-pass bypass machine for printing in accordance with the present disclosure.
Figure 2:
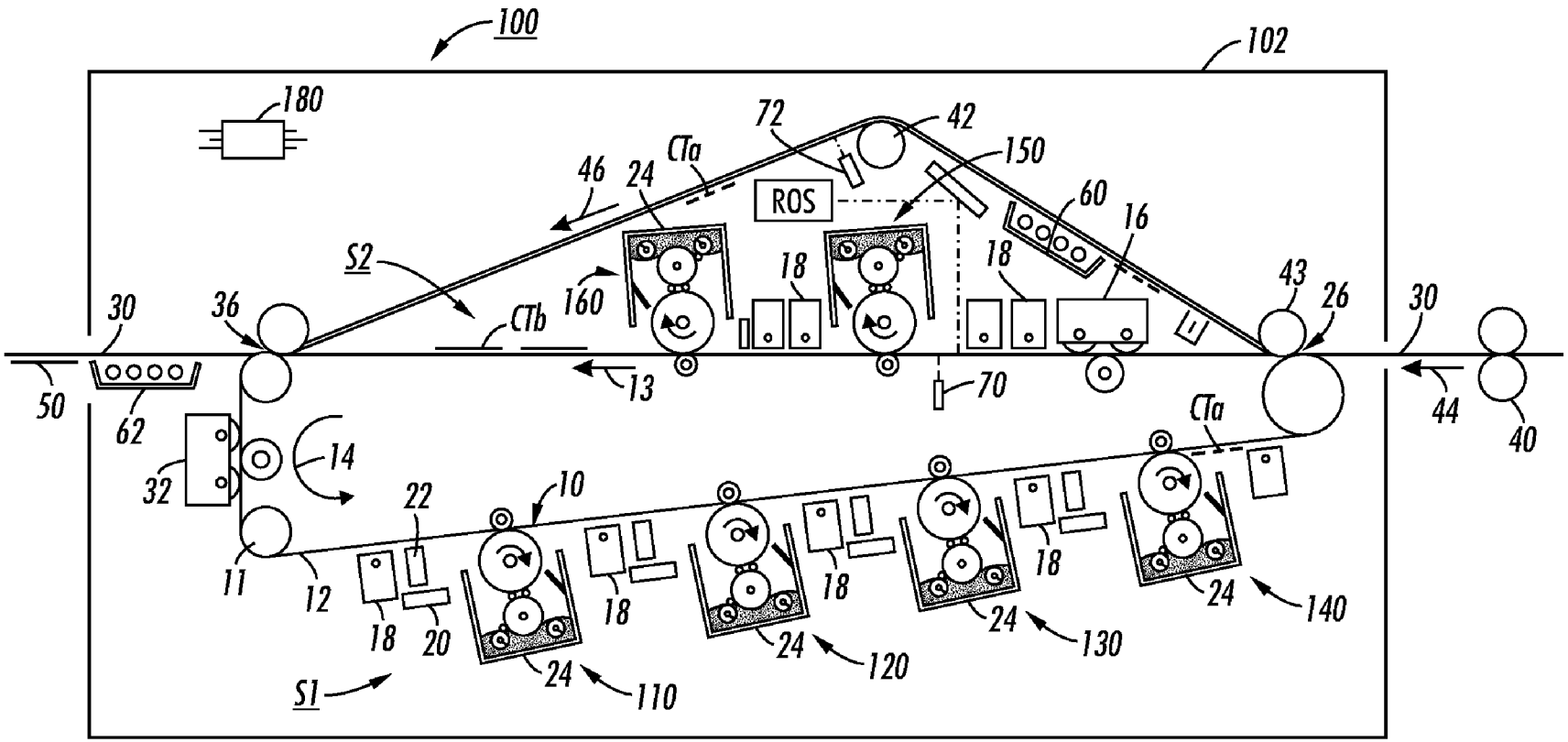
FIG. 2 is a schematic elevational view of a second embodiment of single-pass bypass machine for printing in accordance with the present disclosure.
Figure 3:
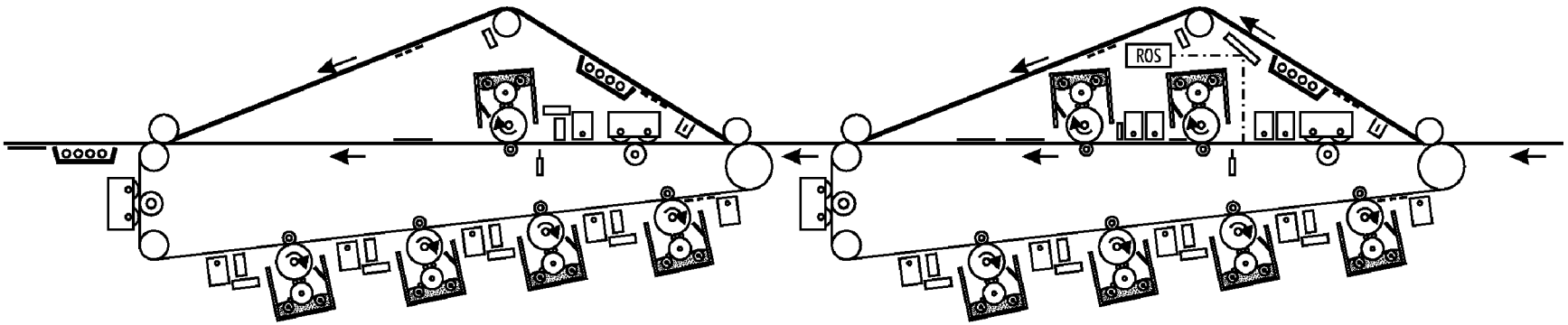
FIG. 3 is a schematic elevational view of an embodiment of a machine for printing in accordance with the present invention where the structures of FIGS. 1 and 2 are located in series.

Referring first to FIG. 1, it schematically illustrates a first embodiment of the single-pass bypass printing machine 100 of the present disclosure. As shown, the single-pass bypass printing machine 100 includes a moveable photoreceptor belt 10 having an imaging charge retentive surface 12 for moving as shown by the arrow 13 through an imaging path 14. The single pass, bypass printing machine 100 further includes a first stage S1 comprising a first cleaning station 16 for cleaning the charge retentive surface 12 of the photoreceptor belt, and a series of imaging subassemblies 110, 120, 130, 140, 150, 160 that each have a charging unit 18 for uniformly charging image frames of the photoreceptor belt, a color separation latent image exposure ROS unit or LED print bar 20 with a graded index lens 22 for image-wise exposing the charged image frames of the photoreceptor to form latent images, and a corresponding color toner development unit 24 for developing the latent images. As the endless photoreceptor belt 10 moves in the direction 13, an image frame thereon is charged, exposed and developed, in succession, by each imaging subassembly 110, 120, 130, 140, 150, 160, with each imaging subassembly thus forming a color separation image corresponding to color separation image input video data from the controller 180. Specifically, after the first color imaging subassembly 110 forms its color separation toner image, that color separation toner image is then recharged and re-exposed by the second or downstream imaging subassembly 120 to form a different color separation latent image, and then correspondingly developed by the development unit thereof. This is repeated until a first multi-color toner image is formed after the final color separation image is thus formed. The first multi-color toner image CTa is then ready to be transferred from the image frame at a first transfer station 26 to a print media 30.

The single pass, bypass printing machine 100 also includes apparatus 40 for supplying and feeding the print media 30 along a main media path 44 as well as along a bypass media path 46. Diverting apparatus 42 including a series of rolls 43 are provided for diverting the print media 30 from the main media path 44 onto the bypass media path 46 and back to the main media path 44.

The single pass, bypass printing also includes a second stage S2 that has a second cleaning station 32 for cleaning surface 12 of the image frame from which the first multi-color toner image CTa was transferred. It also includes at least one imaging subassembly 150, 160 for forming a second color toner image CTb on cleaned surface 12 of the photoreceptor belt 10. As shown, the at least one imaging subassembly 150, 160 comprises a black toner imaging subassembly with a charging unit 18 for uniformly recharging the image frame of the photoreceptor belt, a color separation latent image exposure LED print bar 20 with a graded index lens 22 for image-wise exposing the recharged image frame to form a black latent image, and a corresponding black toner development unit 24 for developing the latent image into a second color (black toner) image CTb. The second stage S2 then includes a second transfer station 36 for transferring the second color toner image CTb onto the print media 30, thus forming a desired fully developed multi-color toner image 50 (CTa plus CTb) on the print media 30.

The method of the present disclosure includes (a) moving the photoreceptor belt 10 through the imaging path 14 including a portion having a first direction 13; (b) first forming a first color toner image CTa on the photoreceptor belt 10; (c) moving a print media 30 along the main media path 44 having the first direction 13; (d) first transferring the first color toner image CTa at the first transfer station 26 onto the print media 30; (e) diverting the print media 30 from moving along the main media path 44 having the first direction 13 into moving along the bypass media path 46 having a second and different direction 45; (f) next forming the second color toner image CTb on the photoreceptor belt 10; (g) moving the print media 30 along the bypass media path 46 back into the main media path 44; and (h) next transferring the second color toner image CTb at the second transfer station 36 onto the print media 30, thus forming the desired multi-color toner image 50 on the print media 30.

More specifically, the single-pass bypass printing machine 100 includes (a) a machine frame 102 defining an imaging path 14 including a portion having a first direction 13, a main media path 44 and a bypass media path 46; (b) a moveable endless photoreceptor belt 10 having a charge retentive surface 12; (c) apparatus 11 for moving the endless photoreceptor belt 10 through the imaging path 14; (d) media apparatus 40 for supplying and feeding print media 30 along the main media path 44 and the bypass media path 46; (e) a first stage S1 including at least three imaging subassemblies 110, 120, 130 for forming a first color toner image CTa on the charge retentive surface 12 of the moveable endless photoreceptor belt 10; (f) a first transfer station 26 for transferring the first color toner image CTa from the charge retentive surface 12 onto the print media 30 moving along the main media path 44; (g) diverting apparatus 42 for diverting the print media 30 from the main media path 44 onto the bypass media path 46; (h) a second stage S2 including at least one imaging subassembly 150, 160 for forming a second color toner image CTb on the charge retentive surface 12 of the moveable endless photoreceptor belt 10; (i) apparatus 43 for moving the print media 30 from the bypass media path 46 back into the main media path 44; and (j) a second transfer station 36 for transferring the second color toner image CTb from the charge retentive surface 12 onto the print media 30, thus forming a desired multi-color toner image 50 on the print media 30.

The print media 30 for example comprises a continuous web. The first stage S1 includes imaging subassemblies 110, 120, 130, 140 consisting of Cyan (C), Magenta (M) & Yellow (Y) corresponding color toners, and a custom color toner (X). The controller 180 or electronic control subsystem (ESS) is preferably a self-contained, dedicated minicomputer having a central processor unit (CPU), electronic storage, and a display or user interface (Ul). The ESS 180, with the help of sensors and connections, can read, capture, prepare and process image data, machine status information, and thus control the functioning of all operational components of the machine 100.

As further illustrated, the single-pass bypass printing machine 100 includes a first fusing apparatus, such as flash fusing apparatus, 60 located along the bypass media path 46 for heating and fusing the first color toner image CTa onto the print media 30. The first stage S1 includes 4 imaging subassemblies 110, 120, 130, 140 comprising cyan, magenta, yellow and a custom color toner imaging subassemblies. The second stage S2 for forming a second color toner image CTb comprises forming a single black toner image 150. The at least one imaging subassembly 150, 160 for next forming a second color toner image CTb comprises forming a first black toner image and a second black toner image.

The single-pass bypass printing machine 100 includes a second cleaning station 32 for cleaning the charge retentive surface 12 after the step of next transferring the second color toner image CTb at the second transfer station 36. It also includes diverting apparatus 42 for diverting the print media 30 from moving along the main media path 44 having the first direction 13 into moving along a bypass media path 46 includes a first flash fusing apparatus 60 for flash fusing the first color toner image CTa along the bypass media path 46 onto the print media 30. It also includes a second flash fusing apparatus 62 for flash fusing the desired multi-color toner image 50 onto the print media 30.

The disclosed single pass multi-stage system 100 includes a first stage S1, a second stage S2, a moving photoreceptor belt 10 having an imaging path 14, and an in-process media path including a diverted or bypass loop (bypass media path) 46. In the first stage S1 a first color image CTa is formed onto the photoreceptor belt 10 and transferred at a first transfer station 26 (that includes a first biased transfer roll), onto print media 30 such as a continuous web. The in-process media or continuous web carrying the transferred first multi-color image CTa is then diverted along the bypass path or loop 46 away from the continued path 14 of the photoreceptor belt 10. The first color image on the in-process media is then fused by a first flash fuser 60 along the bypass path or loop 46 prior to the in-process media 30 being looped back into contact with the photoreceptor belt 10.

Meanwhile, in the second stage S2 downstream of the first transfer station 26, a second color image CTb, for example a black image, is formed on the photoreceptor belt 10 as the photoreceptor belt 10 continues to move towards a second transfer station 36. The in-process media 30 now carrying the fused first color image on it is looped around the bypass path 46 and back into contact with the photoreceptor belt 10 at the second transfer station 36.

At the second transfer station 36, the second color image CTb on the photoreceptor belt 10 is also transferred onto the in-process media 30 already carrying the first color image, thus merging the two images and forming a desired multi-color image on the in-process media. The desired multi-color image is then fused at a second fusing station located down stream of the second transfer station 36 relative to continued travel of the in-process media.

As discussed above, conventional single pass color printing is ordinarily limited to four colors. There are however often demands to add a fifth-color or more, for example in the form of two additional custom colors, and even two blacks (with a MICR option). The addition of such additional colors however creates technological difficulties beyond the four colors; namely, tight color registration requirements, potential disturbance of un-fused images and fusing of high pile height toner layers. Conventional roll fusing of such high pile height images can also cause paper shrinkage resulting in even greater image registration errors, along with other roll fusing related problems such as paper curl, stripper finger marks and jams.

In order to achieve flash fusing of black and color images at the same maximum temperature level, the present disclosure uses the two-stage marking and flash fusing process. In the two-stage marking and flash fusing process, the first stage S1 involves the development and the flash fusing of the first toner color image CTa on the print media 30, and the second stage involves the development and flash fusing of the second color toner image CTb (a black image) on the print media 30 that already has the first toner color image CTa from the first stage. In each stage the maximum toner fusing temperature of the flash fusing stations 60, 62 can be independently controlled at desirable levels for color and black toners respectively.

In a continuous feed (CF) color printer of five developer housings including a custom color as shown in FIG. 1, four color toners Y, M, C and X (yellow, magenta, cyan, custom) are developed in the first stage S1 as the first color toner image CTa and transferred in registration at the first transfer station 26 to a continuous web (media) 30. The black toner (B) is then sequentially developed in the second stage S2 as the second color toner image CTb and also transferred at the second transfer station 36 in registration to the continuous web 30 forming a five-color or multi-color toner image 50. The multi-color image 50 is then flash fused at the second fusing station 62 downstream of the second transfer station 36.

In one embodiment, the first stage S1 comprises four color developer housings 110, 120, 130, 140, including a custom color housing, that are positioned on one side of the photoreceptor belt 10 for developing a first color toner image CTa comprising separation images of the various color toners superimposed in registration on the photoreceptor belt 10. As shown, the first color toner image CTa is then transferred at the first biased transfer roll.

Immediately after such transfer, the print media or continuous web 30 and the photoreceptor belt 10 are separated (at the exit of the first biased transfer roll nip) with the print media 30 then being moved in a second and different direction 45 along a bypass media path 46. The transferred first color toner image CTa now on the separated print media 30 is immediately heated and fixed to the print media 30 at a first fusing station by a first flash fusing apparatus 60 located along the print media bypass path 46 and near the exit of the biased transfer roll nip of the first transfer station 26. As further shown, the first stage S1 includes a cleaning apparatus 26 that is located immediately downstream of the first transfer station 26 for cleaning and removing residual toners from the charge retentive surface 12 of the photoreceptor belt 10 before commencement of second stage imaging steps.

In this one embodiment, the second-stage S2 has imaging units 150, 160 including an LED print bar 20 and a black developer housing 24 located downstream of the cleaning apparatus 26 for forming a second color toner image CTb (a single black toner image) on the photoreceptor belt 10. Forming of the black toner image CTb as such is controlled and timed to allow proper registration thereof with the first color toner image CTa at the second transfer station 36. To further ensure precise registration (at the second transfer station 36) of this black toner image CTb with the fused first color toner images CTa on the print media 30, an image registration sensor 70 is positioned upstream of the black imaging units 150, 160 for detecting a registration mark on the photoreceptor belt 10. In addition, a print media path timing sensor 72 is positioned at a corresponding position along the print media bypass path 44 for interrogating and coordinating with the image registration sensor 70, thereby ensuring the accuracy of registering the black toner image with the fused first color toner image on the print media 30.

The flash energy of the second flash fusing apparatus 62 is optimized to provide adequate fixing of the unfused second color toner or black toner image CTb without overheating it which may cause image voids therein. In the meantime the accompanying already fused first color toner image CTa receives the same flash energy pulse but the repeated heating it produces is at a much lower level due to lower absorption ratio of such flash energy when compared with the absorption ratio for the black toner image CTb. Also, the repeated heating does not impact image quality as the color toners are already cross-linked and hardened by the first flash fusing apparatus 60.

In a second embodiment, the second stage S2 has imaging units 150, 160 for forming a first black toner image and a second black toner image in superposed registration forming the second color toner image. The second black toner image may be a MICR toner image an image of any toner having a high flash energy absorption ratio equivalent to that of the black toners. The second color toner image is then as in the first embodiment transferred at the second transfer station 36 onto the print media 30 and merged in registration with the fused first color toner image CTa already thereon, forming an even more colorful multi-color image. The multi-color image then fused at the second fusing station by the second flash fusing apparatus 62.

For simplicity, the concept of a single-pass bypass printing machine including the two-stage marking and flash fusing concepts has been illustrated above using a continuous feed print media 30 in web form. However, it should be understood that the concepts are equally applicable when using cut-sheet print media. The operation of each xerographic subsystem is well known in the art.

In the first embodiment, the method of the present single-pass bypass printing machine 100 of forming a full color toner image CTa includes (a) moving an endless charge retentive member 12 having a charge retentive surface 12 through an imaging path including a portion having a first direction 13; (b) first forming a first color toner image CTa on the moving charge retentive surface; (c) moving a print media 30 along a main media path 44 having the first direction; (d) first transferring the first color toner image at a first transfer station 26 from the moving charge retentive surface onto a first side of the print media; (e) diverting the print media from moving along the main media path having the first direction into moving along a bypass media path 46 having a second and different direction 45; (f) next forming a second color toner image CTb on the moving charge retentive surface; (g) moving the print media along the bypass media path from the second direction back into the main media path having the first direction; (h) next transferring the second color toner image at a second transfer station 36 from the moving charge retentive surface onto the first side of the print media forming a desired multi-color toner image 50.

As can be seen, there has been provided a single-pass bypass printing machine including: (a) a moveable photoreceptor belt for moving through an imaging path; (b) apparatus for supplying and feeding print media along a main media path and a bypass media path; (c) a first stage including at least three imaging subassemblies for forming a first color toner image on the photoreceptor; (d) a first transfer station for transferring the first color toner image onto the print media; (e) apparatus for diverting the print media from the main media path onto the bypass media path; (f) a second stage including at least one marking engine for forming a second color toner image on the photoreceptor; (g) apparatus for moving the print media from the bypass media path back into the main media path; and (h) a second transfer station for transferring the second color toner image onto the print media, forming a desired multi-color toner image on the print media.

The method of the single pass bypass machine includes (a) moving a photoreceptor through an imaging path including a portion having a first direction; (b) first forming a first color toner image on the photoreceptor; (c) moving a print media along a main media path having the first direction; (d) first transferring the first color toner image at a first transfer station onto the print media; (e) diverting the print media from moving along the main media path having the first direction into moving along a bypass media path having a second and different direction; (f) next forming a second color toner image on the photoreceptor; (g) moving the print media along the bypass media path back into the main media path; and (h) next transferring the second color toner image at a second transfer station onto the print media, forming a desired multi-color toner image.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A single-pass bypass printing method of forming a multi-color toner image in a printing machine, the method comprising:

(a) moving an endless charge retentive member having a charge retentive surface through an imaging path including a portion having a first direction;

(b) first forming a first color toner image on said moving charge retentive surface;

(c) moving a print media along a main media path having said first direction;

(d) first transferring said first color toner image at a first transfer station from said moving charge retentive surface onto a first side of said print media;

(e) diverting said print media from moving along said main media path having said first direction into moving along a bypass media path having a second and different direction;

(f) next forming a second color toner image on said moving charge retentive surface;

(g) moving said print media along said bypass media path from said second direction back into said main media path having said first direction; and (h) next transferring said second color toner image at a second transfer station from said moving charge retentive surface onto said first side of said print media, thereby forming a desired multi-color toner image.

2. The single-pass bypass printing method of claim 1, wherein said step of first forming a first color toner image comprises forming a cyan, magenta and yellow plural colors toner image.

3. The single-pass bypass printing method of claim 1, wherein said step of first forming a first color toner image comprises forming a cyan, magenta, yellow and a custom color plural colors toner image.

4. The single-pass bypass printing method of claim 1, wherein said step of next forming a second color toner image comprises forming a single black toner image.

5. The single-pass bypass printing method of claim 1, wherein said step of next forming a second color toner image comprises forming a first black toner image and a second black toner image.

6. The single-pass bypass printing method of claim 1, wherein said step of diverting said print media from moving along said main media path having said first direction into moving along a bypass media path includes fusing said first color toner image along said bypass media path onto said print media.

7. The single-pass bypass printing method of claim 6, wherein said step of diverting said print media from moving along said main media path having said first direction into moving along a bypass media path includes a step of flash fusing said first color toner image along said bypass media path onto said print media

8. The single-pass bypass printing method of claim 1, wherein said step of next forming a second color toner image comprises forming said second toner image while said charge retentive surface is moving through said portion of said imaging path having said first direction.

9. The single-pass bypass printing method of claim 1, including a step of fusing said desired multi-color toner image onto said print media.

10. The single-pass bypass printing method of claim 9, including a step of flash fusing said desired multi-color toner image onto said print media.

11. The single-pass bypass printing method of claim 1, including a step of cleaning said charge retentive surface before said step of next forming a second color toner image.

12. The single-pass bypass printing method of claim 1, including a step of cleaning said charge retentive surface after said step of next transferring said second color toner image at said second transfer station.

13. A single-pass bypass printing machine comprising:

(a) a machine frame defining an imaging path including a portion having a first direction; a main media path and a bypass media path;

(b) a moveable endless photoreceptor belt having a charge retentive surface;

(c) means for moving said endless photoreceptor belt through said imaging path;

(d) means for supplying and feeding print media along said main media path and said bypass media path;

(e) a first marking stage including at least three imaging subassemblies for forming a first color toner image on said charge retentive surface of said moveable endless photoreceptor;

(f) a first transfer station for transferring said first color toner image from said charge retentive surface onto said print media moving along said main media path;

(e) means for diverting said print media from said main media path onto said bypass media path;

(f) a second marking stage including at least one marking engine for forming a second color toner image on said charge retentive surface of said moveable endless photoreceptor;

(g) means for moving said print media from said bypass media path back into said main media path; and (h) a second transfer station for transferring said second color toner image from said charge retentive surface onto said print media, forming a desired multi-color toner image on said print media.

14. The single-pass bypass printing machine of claim 13, wherein said print media comprises a continuous web.

15. The single-pass bypass printing machine of claim 13, wherein said first marking stage includes cyan, magenta, and yellow imaging subassemblies.

16. The single-pass bypass printing machine of claim 13, including a fusing device located along said bypass media path for heating and fusing said first color toner image onto said print media.

17. The single-pass bypass printing machine of claim 13, wherein said first stage includes 4 imaging subassemblies comprising cyan, magenta, yellow and a custom color toner imaging subassemblies.

18. The single-pass bypass printing machine claim 13, wherein said second marking stage comprises a single black toner image.

19. The single-pass bypass printing machine claim 13, including a flash fusing apparatus for fusing said first color toner image along said bypass media path onto said print media.

20. The single-pass bypass printing machine of claim 13, including a cleaning apparatus for cleaning said charge retentive surface before said second marking stage.

21. The single-pass bypass printing machine of claim 13, including a second cleaning apparatus for cleaning said charge retentive surface after said second transfer station.

* * * * *